US009360262B2

(12) United States Patent
Kim et al.

(10) Patent No.: US 9,360,262 B2
(45) Date of Patent: Jun. 7, 2016

(54) HEAT EXCHANGER FOR VEHICLE

(75) Inventors: Jae Yeon Kim, Hwaseong-si (KR); Wan Je Cho, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 921 days.

(21) Appl. No.: 13/316,193

(22) Filed: Dec. 9, 2011

(65) Prior Publication Data

US 2013/0068432 A1 Mar. 21, 2013

(30) Foreign Application Priority Data

Sep. 19, 2011 (KR) ..... 10-2011-0094222

(51) Int. Cl.

| | |
|---|---|
| ***F28D 9/00*** | (2006.01) |
| ***F28D 21/00*** | (2006.01) |
| ***F28F 27/02*** | (2006.01) |
| ***F28B 1/02*** | (2006.01) |
| ***F01P 7/16*** | (2006.01) |
| ***G05D 23/02*** | (2006.01) |
| *F01K 9/00* | (2006.01) |
| *F28B 5/00* | (2006.01) |
| *F28C 1/14* | (2006.01) |
| *F28B 9/06* | (2006.01) |

(52) U.S. Cl.

CPC ..... *F28F 27/02* (2013.01); *F01K 9/003* (2013.01); *F28B 1/02* (2013.01); *F28B 5/00* (2013.01); *F28B 9/06* (2013.01); *F28C 1/14* (2013.01); *F28D 9/005* (2013.01); *F28D 2021/0089* (2013.01); *F28F 2250/06* (2013.01); *F28F 2255/04* (2013.01)

(58) Field of Classification Search

CPC ..... F28F 27/02; F28F 1/02
USPC ..... 165/103, 167, 297, 280, 283
See application file for complete search history.

(56) References Cited

U.S. PATENT DOCUMENTS

| | | | | |
|---|---|---|---|---|
| 4,336,903 | A * | 6/1982 | Zirps | 236/92 R |
| 5,078,173 | A * | 1/1992 | Spencer et al. | 137/115.1 |
| 6,125,872 | A * | 10/2000 | Cunkelman et al. | 137/75 |
| 6,182,749 | B1 * | 2/2001 | Brost et al. | 165/297 |
| 6,253,837 | B1 | 7/2001 | Seiler et al. | |

(Continued)

FOREIGN PATENT DOCUMENTS

| | | |
|---|---|---|
| CN | 1287610 A | 3/2001 |
| CN | 1620589 A | 5/2005 |

(Continued)

*Primary Examiner* — M. Alexandra Elve
*Assistant Examiner* — Joel Attey
(74) *Attorney, Agent, or Firm* — Morgan, Lewis & Bockius LLP

(57) ABSTRACT

A heat exchanger for a vehicle is disclosed. The heat exchanger includes a heat radiating portion provided with first and second connecting lines formed alternately by stacking a plurality of plates, and receiving first and second operating fluids respectively into the first and second connecting lines. The first and second operating fluids exchange heat with each other during passing through the first and second connecting lines. The heat exchanger also includes a bifurcating portion connecting an inflow hole for flowing one operating fluid of the first and second operating fluids with an exhaust hole for exhausting the one operating fluid, adapted for the one operating fluid to bypass the heat radiating portion according to a temperature of the one operating fluid, and mounted at an exterior of the heat radiating portion.

16 Claims, 9 Drawing Sheets

(56) References Cited

U.S. PATENT DOCUMENTS

| | | | | |
|---|---|---|---|---|
| 6,843,211 | B2 * | 1/2005 | Iwasaki | 123/41.31 |
| 7,198,037 | B2 * | 4/2007 | Sayers et al. | 123/568.12 |
| 7,681,804 | B2 * | 3/2010 | Lockhart | 236/93 A |
| 7,748,442 | B2 * | 7/2010 | Kalbacher et al. | 165/299 |
| 7,819,332 | B2 * | 10/2010 | Martin et al. | 236/34.5 |
| 2002/0069655 | A1 * | 6/2002 | Lee et al. | 62/222 |
| 2003/0019620 | A1 * | 1/2003 | Pineo et al. | 165/297 |
| 2003/0217707 | A1 * | 11/2003 | Iwasaki | 123/41.31 |
| 2006/0076129 | A1 * | 4/2006 | Eliades et al. | 165/297 |
| 2008/0029246 | A1 * | 2/2008 | Fratantonio et al. | 165/103 |
| 2008/0029253 | A1 * | 2/2008 | Kuniavskyi et al. | 165/148 |
| 2008/0093066 | A1 * | 4/2008 | Bird et al. | 165/297 |
| 2008/0099184 | A1 * | 5/2008 | Han | 165/103 |
| 2008/0179051 | A1 * | 7/2008 | Willis et al. | 165/173 |
| 2010/0116465 | A1 | 5/2010 | Jainek et al. | |
| 2010/0175640 | A1 * | 7/2010 | Sheppard | 123/41.09 |
| 2010/0314457 | A1 * | 12/2010 | Todaka et al. | 236/12.16 |

FOREIGN PATENT DOCUMENTS

| | | | |
|---|---|---|---|
| JP | 62-141979 | U | 9/1987 |
| JP | 1-80612 | U | 5/1989 |
| JP | 1-117473 | U | 8/1989 |
| JP | 9-250322 | A | 9/1997 |
| JP | 10-002609 | A | 1/1998 |
| JP | 2001-50673 | A | 2/2001 |
| JP | 2001-508163 | A | 6/2001 |
| JP | 2003-286846 | A | 10/2003 |
| JP | 2009-103359 | A | 5/2009 |
| JP | 2010-216542 | A | 9/2010 |
| JP | 2011-162186 | A | 8/2011 |
| KR | 100644378 | B1 | 11/2006 |

* cited by examiner

HEAT EXCHANGER FOR VEHICLE

CROSS-REFERENCE TO RELATED APPLICATION

The present application claims priority to Korean Patent Application No. 10-2011-0094222 filed in the Korean Intellectual Property Office on Sep. 19, 2011, the entire contents of which is incorporated herein for all purposes by this reference.

BACKGROUND OF THE INVENTION

1. Field of the Invention

The present invention relates to a heat exchanger for a vehicle. More particularly, the present invention relates to a heat exchanger for a vehicle which can control temperatures of operating fluids which flows in the heat exchanger.

2. Description of Related Art

Generally, a heat exchanger transfers heat from high-temperature fluid to low-temperature fluid through a heat transfer surface, and is used in a heater, a cooler, an evaporator, and a condenser.

Such a heat exchanger reuses heat energy or controls a temperature of an operating fluid flowing therein for demanded performance. The heat exchanger is applied to an air conditioning system or a transmission oil cooler of a vehicle, and is mounted at an engine compartment.

Since the heat exchanger is hard to be mounted at the engine compartment with restricted space, studies for the heat exchanger with smaller size, lighter weight, and higher efficiency have been developed.

A conventional heat exchanger controls the temperatures of the operating fluids according to a condition of a vehicle and supplies the operating fluids to an engine, a transmission, or an air conditioning system. For this purpose, bifurcation circuits and valves are mounted on each hydraulic line through which the operating fluids operated as heating medium or cooling medium passes. Therefore, constituent elements and assembling processes increase and layout is complicated.

If additional bifurcation circuits and valves are not used, heat exchanging efficiency cannot be controlled according to flow amount of the operating fluid. Therefore, the temperature of the operating fluid cannot be controlled efficiently.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a heat exchanger for a vehicle having advantages of simultaneously warming up and cooling operating fluids according to temperatures of the operating fluids at a running state or an initial starting condition of the vehicle when the operating fluids are heat exchanged with each other in the heat exchanger.

Various aspects of the present invention are directed to providing a heat exchanger for a vehicle having further advantages of improving fuel economy and heating performance by controlling the temperatures of the operating fluids according to a condition of the vehicle.

In an aspect of the present invention, a heat exchanger for a vehicle may include a heat radiating portion provided with first and second connecting lines formed alternately by stacking a plurality of plates, and receiving first and second operating fluids respectively into the first and second connecting lines, the first and second operating fluids heat-exchanging with each other during passing through the first and second connecting lines, and a bifurcating portion connecting an inflow hole for flowing one operating fluid of the first and second operating fluids with an exhaust hole for exhausting the one operating fluid, wherein the bifurcating portion is adapted for the one operating fluid to bypass the heat radiating portion according to a temperature of the one operating fluid, and mounted at an exterior of the heat radiating portion.

The first operating fluid flows into the heat radiating portion through a first inflow hole and flows out from the heat radiating portion through a first exhaust hole, and the first inflow hole is connected to the first exhaust hole through the first connecting line, the second operating fluid flows into the heat radiating portion through a second inflow hole and flows out from the heat radiating portion through a second exhaust hole, and the second inflow hole is connected to the second exhaust hole through the second connecting line, the first and second inflow holes are formed at both sides of a surface of the heat radiating portion along a length direction, and the first and second exhaust holes are distanced from the first and second inflow holes and are formed at the both sides of the surface of the heat radiating portion along the length direction.

The first inflow hole and the first exhaust hole are formed at corner portions of the surface of the heat radiating portion facing diagonally with each other.

The second inflow hole and the second exhaust hole are formed at corner portions of the surface of the heat radiating portion at which the first inflow hole and the first exhaust hole are not positioned and which face diagonally with each other.

The bifurcating portion may include a connecting pipe connecting the first inflow hole with the first exhaust hole at the exterior of the heat radiating portion and having an inflow port formed at a position close to the first inflow hole and an exhaust port confronting the inflow port and formed at a position close to the first exhaust hole, and a valve unit mounted at one end portion of the connecting pipe between the first inflow hole and the inflow port, and adapted to extend or contract according to the temperature of the operating fluid to selectively close the first inflow hole such that the operating fluid flowing in through the inflow port flows directly to the exhaust port or flows into the first inflow hole of the heat radiating portion.

The valve unit may include a mounting cap fixedly mounted to one end of the connecting pipe close to the first inflow hole, and a deformable member having one end portion connected to the mounting cap inserted in the connecting pipe, and adapted to extend or contract according to the temperature of the operating fluid and selectively close the inflow port.

The deformable member is made from shape memory alloy adapted to extend or contract according to the temperature of operating fluid.

The deformable member is formed by overlapping and contacting a plurality of ring members with each other in a coil spring shape.

The deformable member may include a pair of fixed portions positioned at both sides thereof in a length direction and adapted not to being deformed according to the temperature, and a deformable portion disposed between the pair of fixed portions and adapted to extend or contract according to the temperature of the operating fluid.

The mounting cap may include an inserting portion having one end portion inserted in and fixed to the deformable member, and a mounting portion having one end integrally connected to the other end of the inserting portion, and mounted at an interior circumference of the connecting pipe.

A screw is formed at an exterior circumference of the mounting portion so as to be threaded to the interior circumference of the connecting pipe.

A blocking portion for being blocked by an end portion of the connecting pipe is integrally formed with the other end of the mounting portion.

A tool hole is formed at an interior circumference of the blocking portion.

The heat exchanger may further include sealing for preventing the operating fluid from leaking from the connecting pipe, wherein the sealing is mounted between the mounting portion and the inserting portion.

The heat exchanger may further include an end cap mounted at the other end of the deformable member, wherein the end cap is provided with a penetration hole for coping with a pressure changing according to flowing amount of the operating fluid flowing in through the inflow port and flowing the operating fluid in the deformable member so as to improve temperature responsiveness of the deformable member.

The first operating fluid is a coolant flowing from a radiator and the second operating fluid is a transmission oil flowing from an automatic transmission, wherein the coolant circulates through the first inflow hole, the first connecting line, and the first exhaust hole, and the transmission oil circulates through the second inflow hole, the second connecting line, and the second exhaust hole.

The heat radiating portion heat-exchanges the first and second operating fluids by counterflow of the first and second operating fluids.

The heat radiating portion is a heat radiating portion of plate type where a plurality of plates is stacked.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
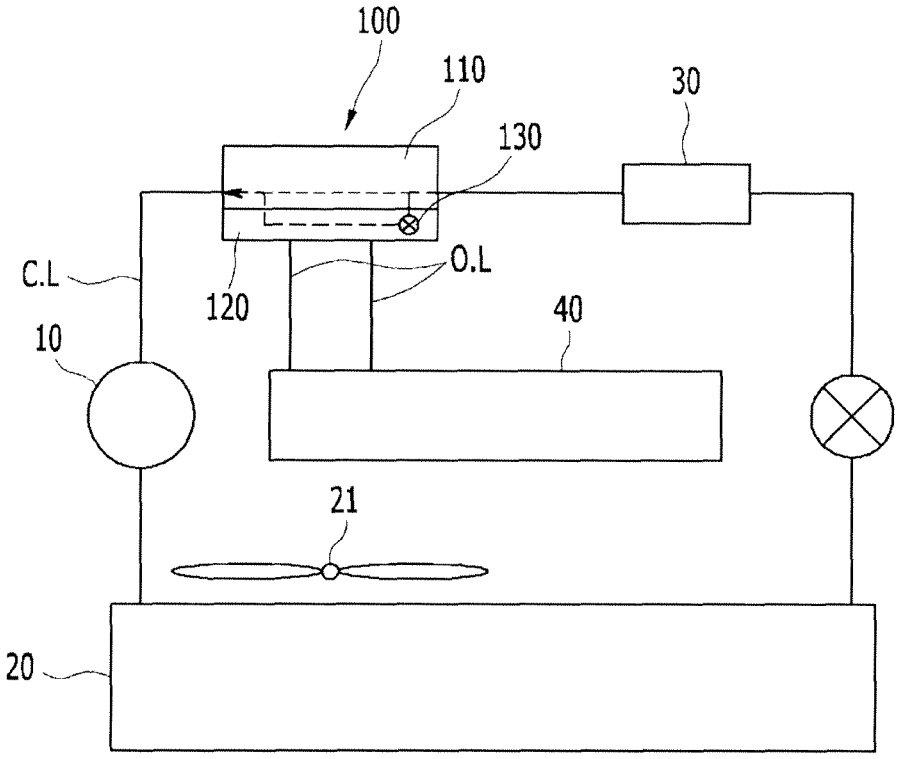
FIG. 1 is a schematic diagram of a cooling system of an automatic transmission to which a heat exchanger for a vehicle according to an exemplary embodiment of the present invention is applied.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

Exemplary embodiments described in this specification and drawings are just exemplary embodiments of the present invention. It is to be understood that there can be various modifications and equivalents included in the spirit of the present invention at the filing of this application.

Figure 2:
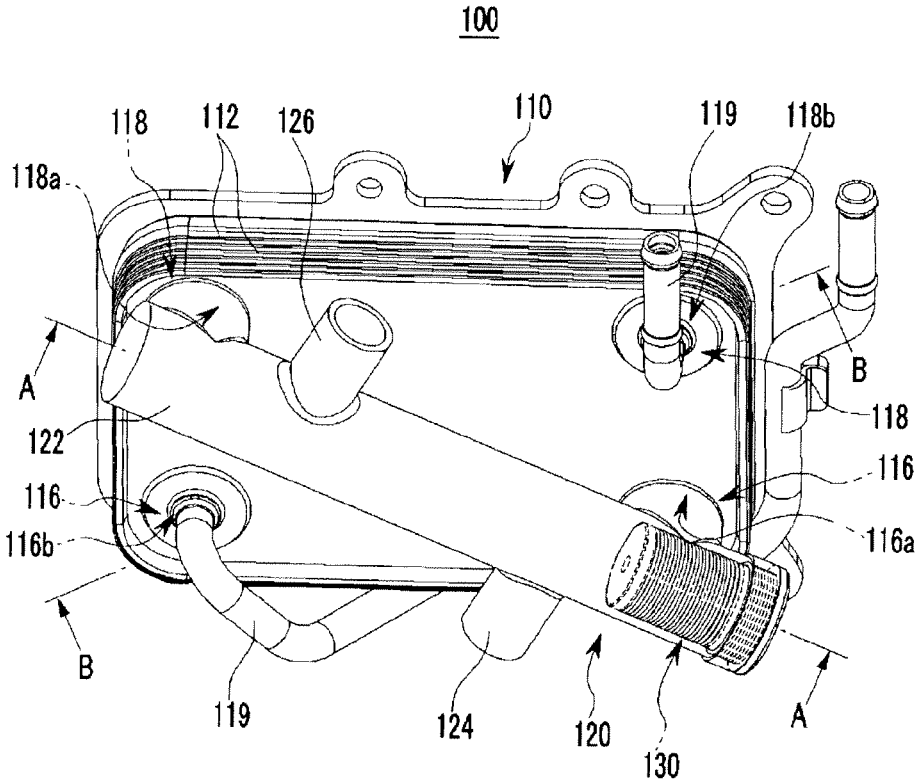
FIG. 2 is a perspective view of a heat exchanger for a vehicle according to an exemplary embodiment of the present invention.
Figure 3:
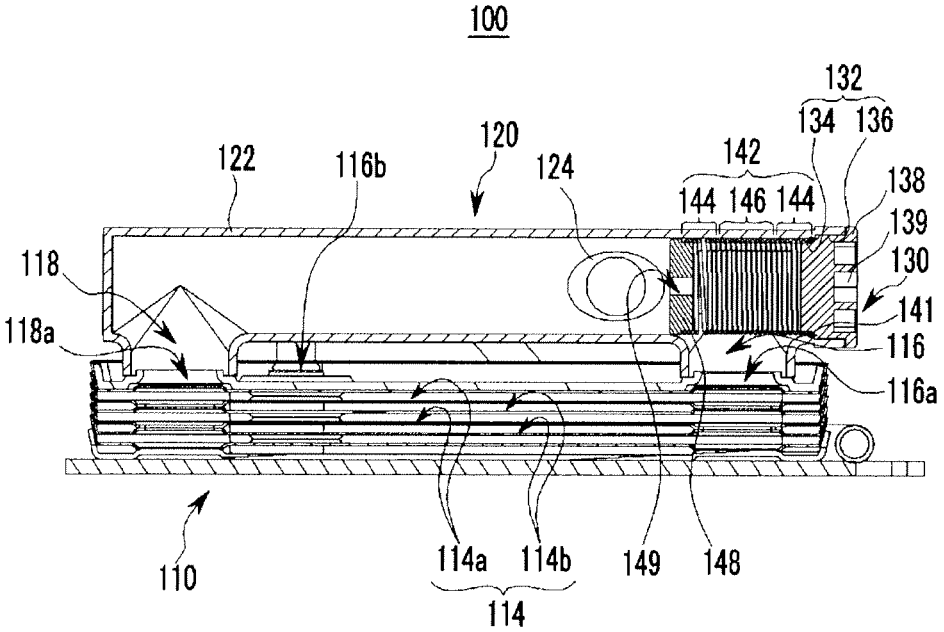
FIG. 3 is a cross-sectional view taken along the line A-A in FIG. 2.
Figure 4:
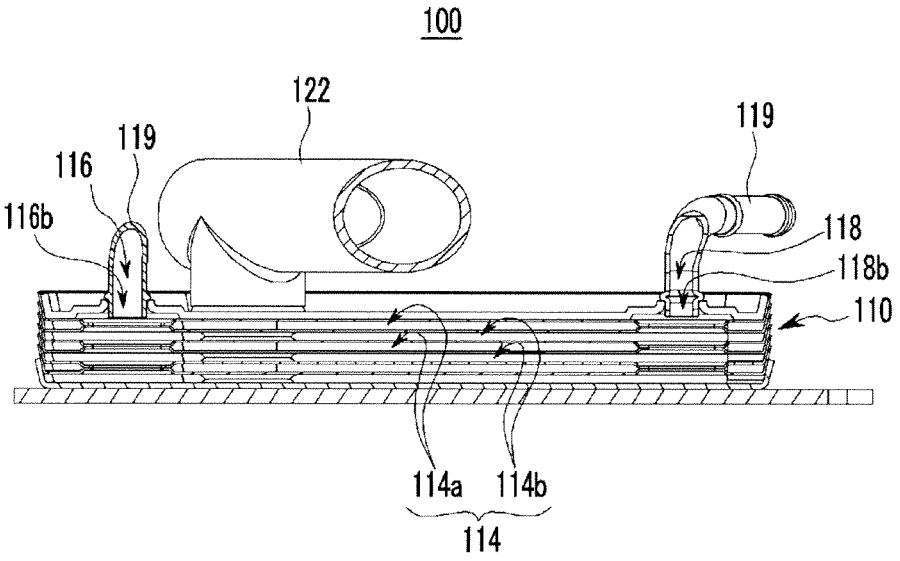
FIG. 4 is a cross-sectional view taken along the line B-B in FIG. 2.
Figure 5:
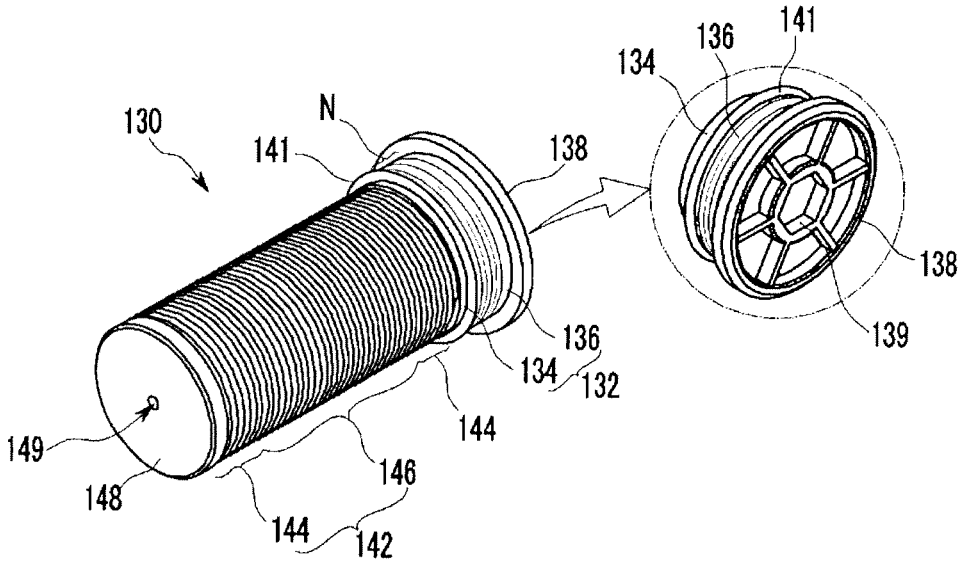
FIG. 5 is a perspective view of a valve unit used in a heat exchanger for a vehicle according to an exemplary embodiment of the present invention.
Figure 6:
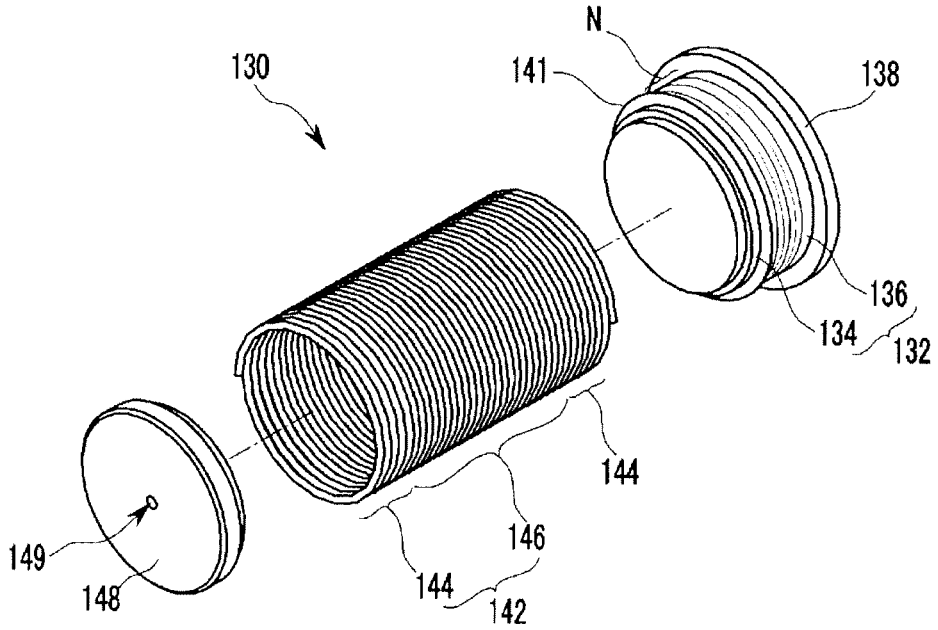
FIG. 6 is an exploded perspective view of a valve unit according to an exemplary embodiment of the present invention.

FIG. 1 is a schematic diagram of a cooling system of an automatic transmission to which a heat exchanger for a vehicle according to an exemplary embodiment of the present invention is applied, FIG. 2 is a perspective view of a heat exchanger for a vehicle according to an exemplary embodiment of the present invention, FIG. 3 is a cross-sectional view taken along the line A-A in FIG. 2, FIG. 4 is a cross-sectional view taken along the line B-B in FIG. 2, FIG. 5 is a perspective view of a valve unit used in a heat exchanger for a vehicle according to an exemplary embodiment of the present invention, and FIG. 6 is an exploded perspective view of a valve unit according to an exemplary embodiment of the present invention.

Referring to the drawings, a heat exchanger 100 for a vehicle according to an exemplary embodiment of the present invention applies to a cooling system of an automatic transmission for a vehicle.

The cooling system of the automatic transmission, as shown in FIG. 1, is provided with a cooling line C.L for cooling an engine. A coolant passes through the radiator 20 having a cooling fan 21 through a water pump 10 and is cooled by the radiator 20. A heater core 30 connected to a heating system of the vehicle is mounted at the cooling line C.L.

A heat exchanger 100 for a vehicle according to an exemplary embodiment of the present invention warms up or cools operating fluids according to temperatures of the operating fluids flowing in at a running state or an initial starting condition of the vehicle when the temperatures of the operating fluids are controlled in the heat exchanger 100 through heat exchange.

For this purpose, the heat exchanger 100 for a vehicle according to an exemplary embodiment of the present invention is disposed between the water pump 10 and the heater core 30, and is connected to an automatic transmission 40 through an oil line O.L.

That is, the operating fluids include a coolant flowing from the radiator 20 and a transmission oil flowing from the automatic transmission 40 according to the present exemplary embodiment. The coolant and the transmission oil are heat exchanged with each other in the heat exchanger 100 such that a temperature of the transmission oil is controlled.

The heat exchanger 100, as shown in FIG. 2, includes a heat radiating portion 110 and a bifurcating portion 120, and the heat radiating portion 110 and the bifurcating portion 120 will be described in detail.

The heat radiating portion 110 is formed by stacking a plurality of plates 112, and a plurality of connecting lines 114 is formed between the neighboring plates 112. In addition, the coolant flows through one of the neighboring connecting lines 114, and the transmission oil flows through the other of the neighboring connecting lines 114. At this time, heat is exchanged between the coolant and the transmission oil.

The heat radiating portion 110 exchanges heat between the coolant and the transmission oil through counterflow of the coolant and the transmission oil.

The heat radiating portion 110 is a heat radiating portion of plate type (or disk type) where the plurality of plates 112 is stacked.

In addition, the bifurcating portion 120 connects one of inflow holes 116 for flowing the operating fluids into the heat radiating portion 110 with one of exhaust holes 118 for discharging the operating fluids from the heat radiating portion 110, and is mounted at an exterior of the heat radiating portion 110. The bifurcating portion 120 is configured for the operating fluid to bypass the heat radiating portion 110 according to the temperature of the operating fluid.

The inflow holes 116 includes first and second inflow holes 116*a* and 116*b* formed at both sides of a surface of the heat radiating portion 110 along a length direction according to the present exemplary embodiment.

In addition, the exhaust holes 118 includes first and second exhaust holes 118*a* and 118*b* formed at the both sides of the surface of the heat radiating portion 110 along the length direction. The first and second exhaust holes 118*a* and 118*b* correspond to the first and second inflow holes 116*a* and 116*b* and are distanced from the first and second inflow holes 116*a* and 116*b*. The first and second exhaust holes 118*a* and 118*b* are connected respectively to the first and second inflow holes 116*a* and 116*b* through the respective connecting line 114 in the heat radiating portion 110.

The first inflow hole 116*a* and the first exhaust hole 118*a* are formed at corner portions of the surface of the heat radiating portion 110 diagonally.

The second inflow hole 116*b* and the second exhaust hole 118*b* are formed at corner portions of the surface of the heat radiating portion 110 diagonally, and confronts respectively with the first inflow hole 116*a* and the first exhaust hole 118*a*.

The bifurcating portion 120 includes a connecting pipe 122 and a valve unit 130, and the connecting pipe 122 and the valve unit 130 will be described in detail.

The connecting pipe 122 connects the first inflow hole 116*a* with the first exhaust hole 116*b* at the exterior of the heat radiating portion 110, and has an inflow port 124 formed at a position close to the first inflow hole 116*a* and an exhaust port 126 confronting the inflow port 124 and formed at a position close to the first exhaust hole 118*a*.

In addition, the valve unit 130 is mounted at an end portion of the connecting pipe 122 corresponding to the first inflow hole 116*a*, and extends or contracts according to the temperature of the operating fluid.

Accordingly, the valve unit 130 flows the operating fluid flowing therein through the inflow port 124 directly to the exhaust port 126 without passing through the heat radiating portion 110 or passes the operating fluid through the heat radiating portion 110 by flowing the operating fluid into the first inflow hole 116*a* and then exhausting the operating fluid from the heat radiating portion 110 through the first exhaust hole 118*a*.

The coolant flowing through the inflow port 124 bypasses the heat radiating portion 110 to the exhaust port 126 through the connecting pipe 122 or circulates through the first inflow hole 116*a* the heat radiating portion 110 and the first exhaust hole 118*a* according to selective operation of the valve unit 130. The transmission oil circulates through the second inflow hole 116*b* and the second exhaust hole 118*b*.

Connecting ports 119 are mounted respectively at the second inflow hole 116*b* and the second exhaust hole 118*b*, and are connected to the automatic transmission 40 through a connecting hose connected to the connecting port 119.

In addition, the inflow port 124 and the exhaust port 126 are connected to the radiator 20 through an additional connecting hose.

The connecting lines 114, as shown in FIG. 3 and FIG. 4, includes a first connecting line 114*a* through which the coolant flows and a second connecting line 114*b* through with the transmission oil passes according to the present exemplary embodiment. The first connecting line 114*a* and the second connecting line 114*b* are formed alternately.

The valve unit 130, as shown in FIG. 5 and FIG. 6, includes a mounting cap 132 and a deformable member 142, and the mounting cap 132 and the deformable member 142 will be described in detail.

The mounting cap 132 is fixedly mounted at an end of the connecting pipe 122 close to the connecting port 124.

The mounting cap 132 includes an inserting portion 134 having an end portion fitted in the deformable member 142, and a mounting portion 136 integrally connected to the other end of the inserting portion 134 and mounted at an interior circumference of the connecting pipe 122.

According to the present exemplary embodiment, a screw N is formed at an exterior circumference of the mounting portion 136 such that the mounting portion 136 is threaded to an interior circumference of the connecting pipe 122, and tab forming is performed at the interior circumference of the connecting pipe 122 corresponding to the screw N.

In addition, an end of the mounting portion 136 is connected to the inserting portion 134, and a blocking portion 138 is integrally formed at the other end of the mounting portion 136. The blocking portion 138 is blocked by the end portion of the connecting pipe 122 such that it is prevented the mounting portion 136 from being inserted further in the connecting pipe 122.

A tool hole 139 in which a tool is inserted is formed at an interior circumference of the blocking portion 138. After the tool is inserted in the tool hole 139, the mounting cap 132 is rotated such that the mounting portion 136 is threaded to the connecting pipe 122.

According to the present exemplary embodiment, a sealing 141 is mounted between the mounting portion 136 and the inserting portion 134. The sealing 141 prevents the operating fluid flowing into the connecting pipe 122 from being leaked from the connecting pipe 122.

That is, the sealing 141 seals a gap between the interior circumference of the connecting pipe 122 and the exterior circumference of the mounting portion 136 such that the operating fluid is prevented from being leaked along the screw N of the mounting portion 136 threaded to the connecting pipe 122.

The deformable member 142 has an end portion connected to the mounting cap 132 inserted in the connecting pipe 122, and extends or contracts according to the temperature of the operating fluid.

The deformable member 142 can be made from shape memory alloy that can extend or contract according to the temperature of the operating fluid.

The shape memory alloy (SMA) is alloy that remembers a shape at a predetermined temperature. The shape of the shape memory alloy can be changed at a different temperature from the predetermined temperature. If the shape memory alloy, however, is cooled or heated to the predetermined temperature, the shape memory alloy returns to an original shape.

The deformable member 142 made from the shape memory alloy material includes a pair of fixed portions 144 and a deformable portion 146, and the fixed portion 144 and the deformable portion 146 will be described in detail.

The pair of fixed portions 144 is positioned at both end portions of the deformable member 144 in a length direction, and a shape of the fixed portion does not change according to the temperature.

The mounting cap 132 is connected to one fixed portion 144. The mounting cap 132 is fixed to the deformable member 142 by fitting the inserting portion 134 in an interior circumference of the fixed portion 144.

The deformable portion 146 is positioned between the fixed portions 144, and extends or contracts according to the temperature of the operating fluid.

The deformable member 142 has a shape similar to that of a circular coil spring.

According to the present exemplary embodiment, the other fixed portion 144 is slidably inserted in the connecting pipe 122, and an end cap 148 is mounted at the other fixed portion 144.

At a state where the deformable member 142 of the valve unit 130 extends, the end cap 148 makes the operating fluid flowing through the inflow port 124 not bypass the heat radiating portion 110. That is, the operating fluid is discharged to the exhaust port 126 through the first exhaust hole 118*a* after passing through the first connecting line 114*a*.

A penetration hole 149 is formed at the end cap 148. The operating fluid bypasses to the deformable member 142 through the penetration hole 149. The penetration hole 149 copes with a pressure changing according to flowing amount of the operating fluid flowing in through the inflow port 124 and improves temperature responsiveness of the deformable member 142.

That is, the penetration hole 149 prevents the deformable member 142 from being damaged by the pressure of the operating fluid and flows the operating fluid into the deformable member 142 such that the deformable member 142 responds to temperature change of the operating fluid quickly.

Figure 7:
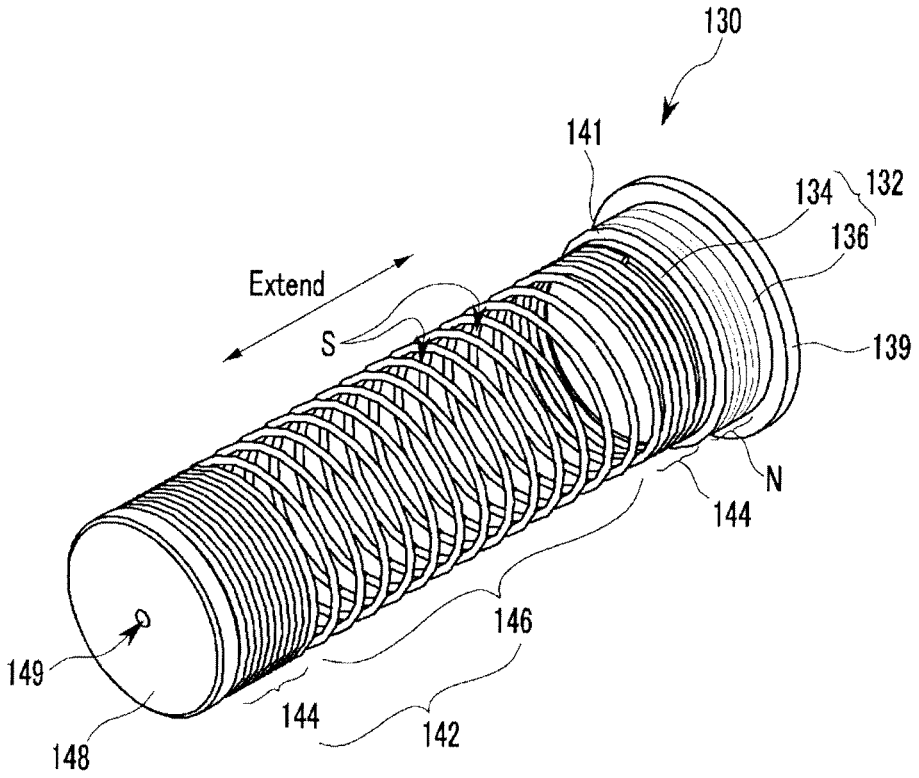
FIG. 7 is a perspective view of a valve unit at an extended state according to an exemplary embodiment of the present invention.

That is, if the operating fluid having a higher temperature than the predetermined temperature flows in the valve unit 130, the deformable portion 146 of the deformable member 142 extends, as shown in FIG. 7.

Accordingly, ring members forming the deformable portion 146 of the deformable member 142 are distanced from each other so as to form a space S, and the operating fluid flows in through the space S.

At this time, ring members forming the fixed portion 144 are fixed to each other by welding, and the fixed portion 144 does not extend.

If the operating fluid having a lower temperature than the predetermined temperature flows into the connecting pipe 122, on the contrary, the deformable portion 146 contracts to an original shape shown in FIG. 5 and the space S is closed.

Operation and function of the heat exchanger 100 according to an exemplary embodiment of the present invention will be described in detail.

Figure 8:
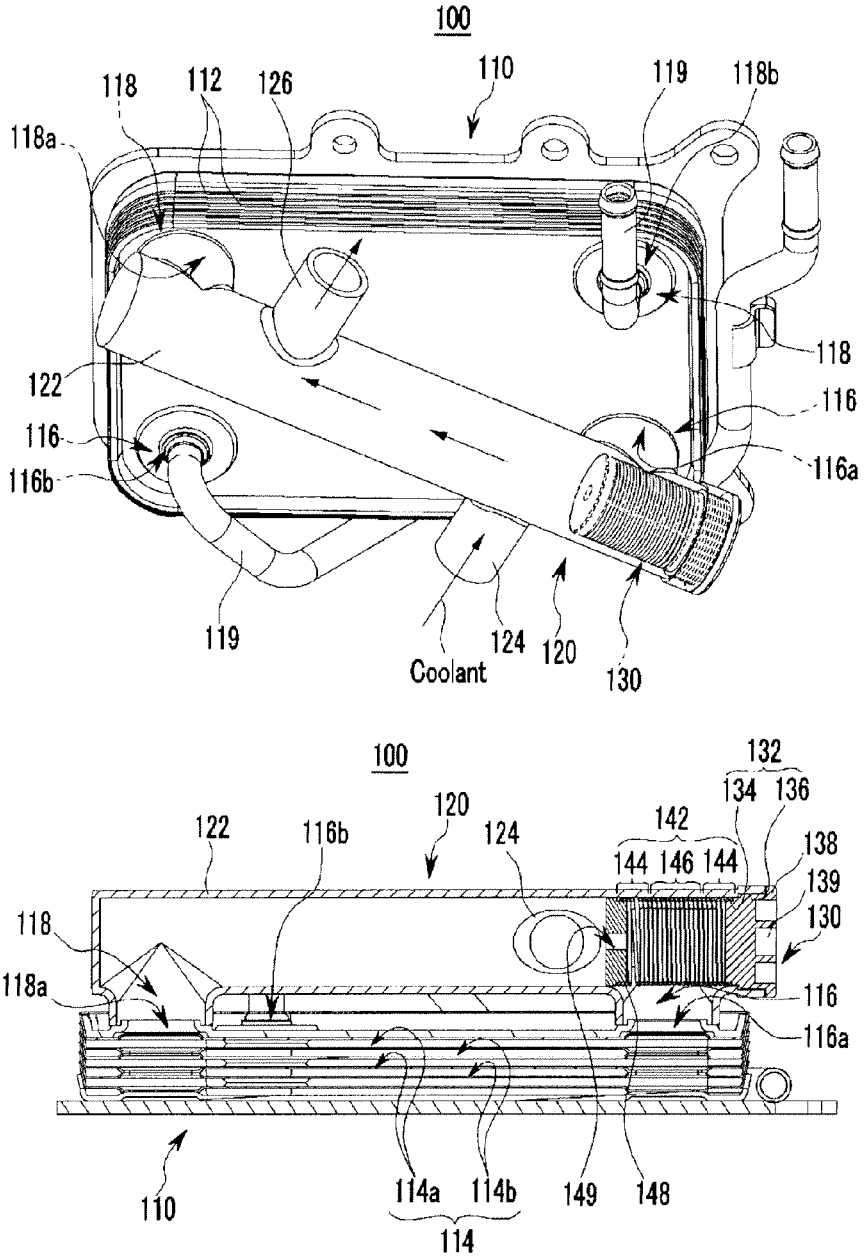
FIG. 8 to FIG. 9 are perspective and cross-sectional views for describing operation of a heat exchanger for a vehicle according to an exemplary embodiment of the present invention.
Figure 9:
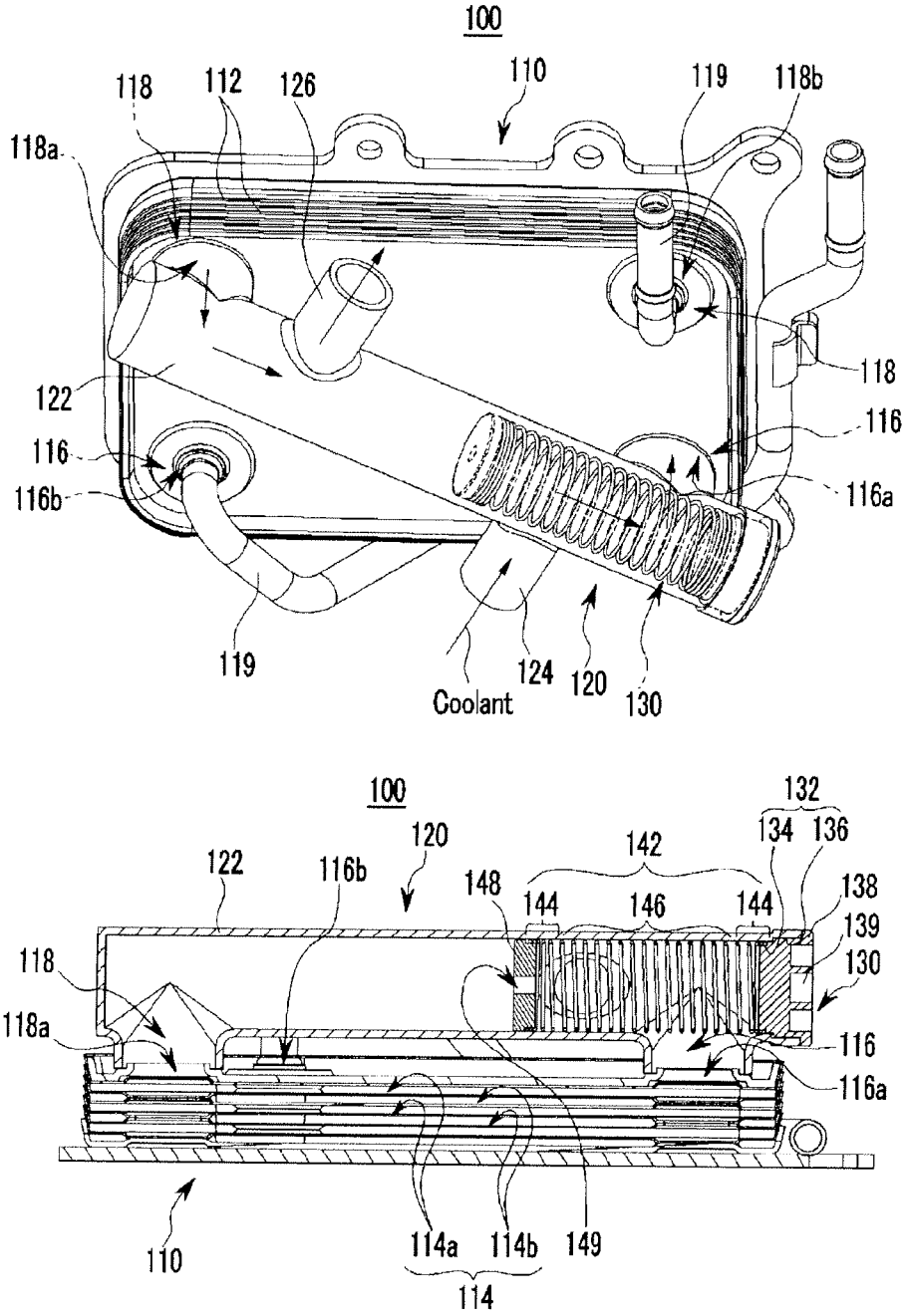

FIG. 8 to FIG. 9 are perspective and cross-sectional views for describing operation of a heat exchanger for a vehicle according to an exemplary embodiment of the present invention.

If the temperature of the coolant flowing into the connecting pipe 122 through the inflow port 124 is lower than the predetermined temperature, the deformable member 142 of the valve unit 130 does not deform and maintains an original shape as shown in FIG. 8.

The coolant does not flow into the first connecting line 114*a* through the first inflow hole 116*a* of the heat radiating portion 110, but flows to the exhaust port 126 along the connecting pipe 122 and is discharged through the exhaust port 126.

Accordingly, the coolant does not flow into the first connecting line 114*a* of the heat radiating portion 110, and does not heat exchange with the transmission oil flowing in the heat radiating portion 110 through the second inflow hole 116*b* and passing through the second connecting line 114*b* of the heat radiating portion 110.

If the transmission oil should be warmed up according to a condition or a mode of the vehicle such as a running state, an idle mode, or an initial starting, the connecting pipe 122 prevents the coolant of low temperature from flowing into the first connecting line 114*a*. Therefore, it is prevented that the temperature of the transmission oil is lowered through heat exchange with the coolant.

If the temperature of the coolant, on the contrary, is higher than the predetermined temperature, the deformable member 142 of the valve unit 130 extends and the space S is formed between the ring members forming the deformable portion 146 as shown in FIG. 9.

The coolant passing through the inflow port 124 flows into the first inflow hole 116*a* through the space S and passes through the first connecting line 114*a* of the heat radiating portion 110. After that, the coolant is discharged to the connecting pipe 122 through the first exhaust hole 118*a*.

The coolant discharged to the connecting pipe 122 flows to the radiator 20 through the exhaust port 126 of the connecting pipe 122.

Therefore, the coolant passes through the first connecting line 114*a* of the heat radiating portion 110 and heat exchanges with the transmission oil flowing in through the second inflow hole 116*b* and passing through the second connecting line 114*b*. Therefore, the temperatures of the coolant and the transmission oil are controlled in the heat radiating portion 110.

Since the first and second inflow holes 116*a* and 116*b* are formed at the corner portions of the heat radiating portion 110 diagonally, the coolant and the transmission oil flow to opposite directions and are heat exchanged. Therefore, heat exchange is performed more efficiently.

Therefore, the transmission oil is cooled through heat exchange with the coolant in the heat radiating portion 110 and is then supplied to the automatic transmission 40.

That is, since the heat exchanger 100 supplies the cooled transmission oil to the automatic transmission 40 rotating at a high speed, occurrence of slip in the automatic transmission 40 is prevented.

The end cap 148 prevents the coolant flowing in through the inflow port 124 at an extended state of the deformable member 142 from being exhausted directly to the exhaust port 126 and exhausts very small amount of the coolant through the penetration hole 149. Therefore, it is prevented that the deformable member 142 is damaged by the pressure of the coolant.

If the heat exchanger 100 according to an exemplary embodiment of the present invention is applied, the operating fluids can be warmed up and cooled simultaneously by using the temperatures of the operating fluids at the running state or the initial starting condition of the vehicle. Therefore, the temperatures of the operating fluids can be controlled efficiently.

Since the temperatures of the operating fluids can be controlled according to the condition of the vehicle, fuel economy and heating performance may be improved. In addition, assembling processes may be reduced due to a simple structure.

Since additional bifurcation circuits are not needed, production cost may be curtailed and workability may be improved.

If the operating fluid is the transmission oil in the automatic transmission 40, hydraulic friction at a cold starting may be lowered due to fast warm up. In addition, slip may be prevented and durability may be maintained at driving due to excellent cooling performance. Therefore, fuel economy and durability of the transmission may be improved.

In addition, since the deformable member 142 is made from the shape memory alloy, structure of the valve unit 130 is very simple. Since the valve unit 130 performs conversion of the hydraulic lines of the operating fluid according to the temperature of the operating fluid, flow of the operating fluid can be controlled accurately. Therefore, constituent elements can be simplified and production cost may be curtailed. In addition, weight may be reduced.

Since responsiveness of the valve according to the temperature of the operating fluid is improved, flow of the operating fluid may be controlled efficiently.

It is exemplified in this specification that the coolant and the transmission oil are used as the operating fluids, but the operating fluids are not limited to these. All the operating fluids that requires warming up or cooling can be used.

In addition, the heat exchanger according to an exemplary embodiment may further include covers and brackets that prevent damage of the heat exchanger and other components or that are used for fixing the heat exchanger to other components or the engine compartment.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A heat exchanger for a vehicle, comprising:

a heat radiating portion provided with first and second connecting lines formed alternately by stacking a plurality of plates, and receiving first and second operating fluids respectively into the first and second connecting lines, the first and second operating fluids heat-exchanging with each other during passing through the first and second connecting lines; and a bifurcating portion connecting an inflow hole for flowing one operating fluid of the first and second operating fluids with an exhaust hole for exhausting the one operating fluid, wherein the bifurcating portion is adapted for the one operating fluid to bypass the heat radiating portion according to a temperature of the one operating fluid, and mounted at an exterior of the heat radiating portion, wherein the first operating fluid flows into the heat radiating portion through a first inflow hole and flows out from the heat radiating portion through a first exhaust hole, and the first inflow hole is connected to the first exhaust hole through the first connecting line, wherein the second operating fluid flows into the heat radiating portion through a second inflow hole and flows out from the heat radiating portion through a second exhaust hole, and the second inflow hole is connected to the second exhaust hole through the second connecting line, wherein the first and second inflow holes are formed at both sides of a surface of the heat radiating portion along a length direction of the heat radiating portion, and the first and second exhaust holes are distanced from the first and second inflow holes and are formed at the both sides of the surface of the heat radiating portion along the length direction of the heat radiating portion, wherein the bifurcating portion comprises:

a connecting pipe connecting the first inflow hole with the first exhaust hole at the exterior of the heat radiating portion, and having an inflow port formed at a position closer to the first inflow hole than to the first exhaust hole and an exhaust port confronting the inflow port and formed at a position closer the first exhaust hole than to the first inflow hole, and a valve unit mounted at one end portion of the connecting pipe between the first inflow hole and the inflow port, and adapted to extend or contract according to the temperature of the operating fluid to selectively close the first inflow hole, wherein the operating fluid flowing in through the inflow port flows directly to the exhaust port when the first inflow hole is closed by the valve unit, or flows into the first inflow hole of the heat radiating portion when the first inflow hole is opened by the valve unit, wherein the valve unit comprises a mounting cap fixedly mounted to one end of the connecting pipe closer to the first inflow hole than to the first exhaust hole, and a deformable member having a first end portion connected to the mounting cap inserted in the connecting pipe and a second end portion disposed outside the mounting cap, and adapted to extend or contract according to the temperature of the operating fluid and selectively close the first inflow hole, wherein the deformable member is formed by overlapping and contacting a plurality of ring members with each other in a coil spring shape, and wherein, when neighboring ring members directly contact each other in response to the temperature of the operating fluid decreasing, the operating fluid flowing into the inflow port flows directly to the exhaust port when neighboring ring members of the ring members directly contact each other such that a gap between the neighboring ring members is closed and contacted neighboring ring members physically seal the first inflow hole and the operating fluid flowing into the inflow port flows directly to the exhaust port, and wherein, when the neighboring ring members are spaced apart from each other in response to the increasing temperature of the operating fluid, the operating fluid flowing into the inflow port flows into the first inflow hole through the gap formed between spaced neighboring ring members.

2. The heat exchanger of claim 1, wherein the first inflow hole and the first exhaust hole are formed at corner portions of the surface of the heat radiating portion facing diagonally with each other.

3. The heat exchanger of claim 1, wherein the second inflow hole and the second exhaust hole are formed at corner portions of the surface of the heat radiating portion at which the first inflow hole and the first exhaust hole are not positioned and which face diagonally with each other.

4. The heat exchanger of claim 1, wherein the deformable member is made from shape memory alloy adapted to extend or contract according to the temperature of operating fluid.

5. The heat exchanger of claim 1, wherein the deformable member comprises:

a pair of fixed portions positioned at both sides of the deformable member in a length direction of the deformable member and adapted not to being deformed according to the temperature; and a deformable portion disposed between the pair of fixed portions and adapted to extend or contract according to the temperature of the operating fluid.

6. The heat exchanger of claim 1, wherein the mounting cap comprises:

an inserting portion having one end portion inserted in and fixed to the deformable member; and a mounting portion having one end integrally connected to the other end of the inserting portion, and mounted at an interior circumference of the connecting pipe.

7. The heat exchanger of claim 6, wherein a screw is formed at an exterior circumference of the mounting portion so as to be threaded to the interior circumference of the connecting pipe.

8. The heat exchanger of claim 6, wherein a blocking portion for being sealed by an end portion of the connecting pipe is integrally formed with the other end of the mounting portion.

9. The heat exchanger of claim 6, wherein a tool hole is formed at an interior circumference of the blocking portion.

10. The heat exchanger of claim 6, further comprising a sealing for preventing the operating fluid from leaking from the connecting pipe, wherein the sealing is mounted between the mounting portion and the inserting portion.

11. The heat exchanger of claim 1, wherein the heat radiating portion heat-exchanges the first and second operating fluids by counterflow of the first and second operating fluids.

12. The heat exchanger of claim 1, wherein the first operating fluid is a coolant flowing from a radiator and the second operating fluid is a transmission oil flowing from an automatic transmission.

13. The heat exchanger of claim 12, wherein the coolant circulates through the first inflow hole, the first connecting line, and the first exhaust hole, and the transmission oil circulates through the second inflow hole, the second connecting line, and the second exhaust hole.

14. A heat exchanger for a vehicle, comprising:

a heat radiating portion provided with first and second connecting lines formed alternately by stacking a plurality of plates, and receiving first and second operating fluids respectively into the first and second connecting lines, the first and second operating fluids exchanging heat with each other during passing through the first and second connecting lines; and a bifurcating portion connecting an inflow hole for flowing one operating fluid of the first and second operating fluids with an exhaust hole for exhausting the one operating fluid, wherein the bifurcating portion is adapted for the one operating fluid to bypass the heat radiating portion according to a temperature of the one operating fluid, and mounted at an exterior of the heat radiating portion, wherein the first operating fluid flows into the heat radiating portion through a first inflow hole and flows out from the heat radiating portion through a first exhaust hole, and the first inflow hole is connected to the first exhaust hole through the first connecting line, wherein the second operating fluid flows into the heat radiating portion through a second inflow hole and flows out from the heat radiating portion through a second exhaust hole, and the second inflow hole is connected to the second exhaust hole through the second connecting line, wherein the first and second inflow holes are formed at both sides of a surface of the heat radiating portion along a length direction of the heat radiating portion, the first and second exhaust holes are distanced from the first and second inflow holes and are formed at the both sides of the surface of the heat radiating portion along the length direction of the heat radiating portion, wherein the bifurcating portion includes a connecting pipe connecting the first inflow hole with the first exhaust hole, and having an inflow port, and a value unit mounted at one end portion of the connecting pipe, wherein the valve unit includes a mounting cap inserted in the connecting pipe and a deformable member having a first end connected to the mounting cap and a second end disposed outside the mounting cap and being in a coil spring shape, and wherein when neighboring ring members of the deformable member are adapted to extend to be spaced from each other in response to the temperature of the operating fluid increasing, a gap is formed between spaced neighboring ring members to open the first inflow hole through the gap and wherein when the neighboring ring members of the deformable member contract to directly contact each other in response to the temperature of the operating fluid decreasing, contacted neighboring ring members physically seal the first inflow hole and the operating fluid flowing into the inflow port flows directly to the exhaust port, wherein the heat exchanger further comprises an end cap mounted at the other end of the deformable member, and wherein the end cap is provided with a penetration hole for coping with a pressure changing according to a flowing amount of the operating fluid flowing in through the inflow port and for flowing the operating fluid in the deformable member to improve temperature responsiveness of the deformable member.

15. The heat exchanger of claim 14, wherein the first operating fluid is a coolant flowing from a radiator and the second operating fluid is a transmission oil flowing from an automatic transmission.

16. The heat exchanger of claim 15, wherein the coolant circulates through the first inflow hole, the first connecting line, and the first exhaust hole, and the transmission oil circulates through the second inflow hole, the second connecting line, and the second exhaust hole.

* * * * *